US011843154B2

(12) United States Patent
Jia et al.

(10) Patent No.: US 11,843,154 B2
(45) Date of Patent: Dec. 12, 2023

(54) BALUN ASSEMBLY, MICROWAVE RADIO FREQUENCY DEVICE AND ANTENNA

(71) Applicants: BEIJING BOE SENSOR TECHNOLOGY CO., LTD., Beijing (CN); BOE TECHNOLOGY GROUP CO., LTD., Beijing (CN)

(72) Inventors: Haocheng Jia, Beijing (CN); Tienlun Ting, Beijing (CN); Ying Wang, Beijing (CN); Jie Wu, Beijing (CN); Liang Li, Beijing (CN); Cuiwei Tang, Beijing (CN); Qiangqiang Li, Beijing (CN); Wei Zhang, Beijing (CN); Chuncheng Che, Beijing (CN)

(73) Assignees: BEIJING BOE SENSOR TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 366 days.

(21) Appl. No.: 17/309,929

(22) PCT Filed: Sep. 25, 2020

(86) PCT No.: PCT/CN2020/117852

§ 371 (c)(1),
(2) Date: Jun. 30, 2021

(87) PCT Pub. No.: WO2022/061746

PCT Pub. Date: Mar. 31, 2022

(65) Prior Publication Data

US 2022/0311115 A1 Sep. 29, 2022

(51) Int. Cl.
*H01P 5/10* (2006.01)
*H01P 3/08* (2006.01)

(52) U.S. Cl.
CPC ..... *H01P 3/08* (2013.01)

(58) Field of Classification Search
CPC ..... H01Q 1/38; H01P 5/10
See application file for complete search history.

*Primary Examiner* — Graham P Smith
(74) *Attorney, Agent, or Firm* — Nath, Goldberg & Meyer; Joshua B. Goldberg

(57) ABSTRACT

A balun assembly is provided. The balun assembly includes a first substrate having first and second surfaces opposite to each other, a first transmission electrode on the first surface of the first substrate, a ground electrode having an opening therein and on a side of the first substrate distal to the first transmission electrode, a first dielectric layer on a side of the ground electrode distal to the first substrate, and second and third transmission electrodes both on a side of the first dielectric layer distal to the ground electrode, the second and third transmission electrodes being spaced apart from each other. Orthographic projections of the first, second and third transmission electrodes on the first substrate intersect with an orthographic projection of the opening on the first substrate at first, second and third intersection points, respectively, and the first intersection point is between the second and third intersection points.

20 Claims, 2 Drawing Sheets

BALUN ASSEMBLY, MICROWAVE RADIO FREQUENCY DEVICE AND ANTENNA

This is a National Phase Application filed under 35 U.S.C. 371 as a national stage of PCT/CN2020/117852, filed Sep. 25, 2020, the content of which is hereby incorporated by reference in its entirety.

TECHNICAL FIELD

The present disclosure relates to the field of communication technology, and in particular to a balun assembly, a microwave radio frequency device, and an antenna.

BACKGROUND

A balun (i.e., balance-unbalance) assembly is a three-port (or three-terminal) device that may be applied to a microwave radio frequency device. The balun assembly is a radio frequency transmission line transformer that converts a matching input into a differential input, and may be used for exciting a differential line, an amplifier, a wideband antenna, a balanced mixer, a balanced frequency multiplier and modulator, a phase shifter, and any circuit design that requires transmission of signals with equal amplitudes and a phase difference of 180° on two lines. Here, two outputs of the balun assembly have equal amplitudes and opposite phases, which means that there is a phase difference of 180° between the two outputs in the frequency domain, and that a voltage of one balanced output is a negative value of a voltage of the other balanced output in the time domain.

SUMMARY

The present disclosure aims to solve at least one of technical problems in the prior art and provides a balun assembly, a microwave radio frequency device, and an antenna.

In a first aspect, embodiments of the present disclosure provide a balun assembly, which includes:

a first substrate having a first surface and a second surface opposite to each other;

a first transmission electrode on the first surface of the first substrate;

a ground electrode having an opening therein, the ground electrode being on a side of the first substrate distal to the first transmission electrode;

a first dielectric layer on a side of the ground electrode distal to the first substrate; and a second transmission electrode and a third transmission electrode both on a side of the first dielectric layer distal to the ground electrode, the second transmission electrode and the third transmission electrode being spaced apart from each other, wherein each of an orthographic projection of the first transmission electrode on the first substrate, an orthographic projection of the second transmission electrode on the first substrate, and an orthographic projection of the third transmission electrode on the first substrate overlaps an orthographic projection of the opening on the first substrate, the orthographic projections of the first transmission electrode, the second transmission electrode and the third transmission electrode on the first substrate intersect with the orthographic projection of the opening on the first substrate at a first intersection point, a second intersection point, and a third intersection point, respectively, and the first intersection point is between the second intersection point and the third intersection point.

In an embodiment, the first transmission electrode has a first signal end and a first open end opposite to each other, the second transmission electrode has a second signal end and a second open end opposite to each other, and the third transmission electrode has a third signal end and a third open end opposite to each other; and a line length of the first transmission electrode from the first open end to the first intersection point is L1, a line length of the second transmission electrode from the second open end to the second intersection point is L2, a line length of the third transmission electrode from the third open end to the third intersection point is L3, and each of the line lengths L1, L2 and L3 is substantially equal to ¼ of a medium wavelength.

In an embodiment, an orthographic projection of the second open end on the first substrate and an orthographic projection of the third open end on the first substrate are on a same side of the opening, a line length of the second transmission electrode from the second intersection point to the second signal end is L4, a line length of the third transmission electrode from the third intersection point to the third signal end is L5, and the line lengths L5 and L4 have a difference of ½ of a medium wavelength therebetween.

In an embodiment, a portion of the third transmission electrode from the third intersection point to the third signal end includes a serpentine line.

In an embodiment, an orthographic projection of the first transmission electrode on the first substrate, an orthographic projection of the second transmission electrode on the first substrate, and an orthographic projection of the third transmission electrode on the first substrate overlap each other.

In an embodiment, an orthographic projection of the second open end on the first substrate and an orthographic projection of the third open end on the first substrate are on both sides of the opening, respectively, a line length of the second transmission electrode from the second intersection point to the second signal end is L4, a line length of the third transmission electrode from the third intersection point to the third signal end is L5, and the line lengths L4 and L5 are substantially equal to each other.

In an embodiment, each of the first transmission electrode, the second transmission electrode, and the third transmission electrode includes a serpentine line.

In an embodiment, the balun assembly further includes a second substrate opposite to the first dielectric layer and at a side of the first dielectric layer distal to the ground electrode, both the second transmission electrode and the third transmission electrode are on the first dielectric layer, and a second dielectric layer is between a layer where the second transmission electrode and third transmission electrode are located and the second substrate.

In an embodiment, the balun assembly further includes a second substrate opposite to the first dielectric layer and at a side of the first dielectric layer distal to the ground electrode;

one of the second transmission electrode and the third transmission electrode is on the first dielectric layer, and the other of the second transmission electrode and the third transmission electrode is on a side of the second substrate proximal to the first dielectric layer; or both the second transmission electrode and the third transmission electrode are on a side of the second substrate proximal to the first dielectric layer; and a second dielectric layer is between a layer where the second transmission electrode is located and a layer where the third transmission electrode is located.

In an embodiment, the second dielectric layer includes a liquid crystal layer.

In an embodiment, a width of the opening in an extension direction of the opening ranges from ¼ of a medium wavelength to ½ of the medium wavelength.

In a second aspect, embodiments of the present disclosure provide a microwave radio frequency device, which including the balun assembly according to any one of foregoing embodiments.

In an embodiment, the microwave radio frequency device includes a phase shifter or a filter.

In a third aspect, embodiments of the present disclosure provide an antenna, which includes the microwave radio frequency device according to any one of foregoing embodiments.

DETAILED DESCRIPTION

To enable one of ordinary skill in the art to better understand technical solutions of the present disclosure, the present disclosure will be further described in detail below with reference to the accompanying drawings and exemplary embodiments.

Unless defined otherwise, technical or scientific terms used herein should have the ordinary meaning as understood by one of ordinary skill in the art to which the present disclosure belongs. The terms of "first", "second", and the like used in the present disclosure are not intended to indicate any order, quantity, or importance, but rather are used for distinguishing one element from another. Further, the terms "a", "an", "the", or the like do not denote a limitation of quantity, but rather denote the presence of at least one element. The term of "comprising", "including", or the like, means that the element or item preceding the term contains the element or item listed after the term and its equivalent, but does not exclude the presence of other elements or items. The term "connected", "coupled", or the like is not limited to physical or mechanical connections, but may include electrical connections, whether direct or indirect connections. The terms "upper", "lower", "left", "right", and the like are used merely for indicating relative positional relationships, and when the absolute position of the object being described is changed, the relative positional relationships may also be changed accordingly.

As described above, a balun (i.e., balance-unbalance) assembly is a three-port (or three-terminal) device that may be applied to a microwave radio frequency device. The balun assembly is a radio frequency transmission line transformer that converts a matching input into a differential input, and may be used for exciting a differential line, an amplifier, a wideband antenna, a balanced mixer, a balanced frequency multiplier and modulator, a phase shifter, and any circuit design that requires transmission of signals with equal amplitudes and a phase difference of 180° on two lines. Here, two outputs of the balun assembly have equal amplitudes and opposite phases, which means that there is a phase difference of 180° between the two outputs in the frequency domain, and that a voltage of one balanced output is a negative value of a voltage of the other balanced output in the time domain.

It should be noted that, in an embodiment of the present disclosure, description will be made by taking an example in which a microwave radio frequency device is a phase shifter, but it should be understood that an embodiment of the present disclosure is not limited to the example in which the microwave radio frequency device is the phase shifter.

Figure 1:
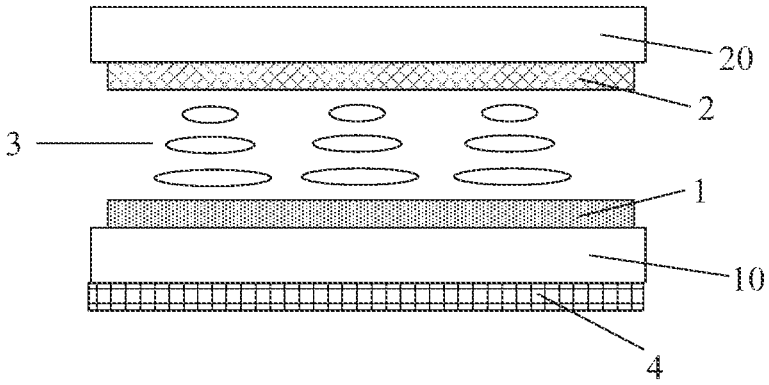
FIG. 1 is a schematic diagram of an exemplary phase shifting structure.

In an example, the phase shifter includes not only a balun assembly, but also a phase shifting structure. FIG. 1 is a schematic diagram of an exemplary phase shifting structure. As shown in FIG. 1, the phase shifting structure includes a first base plate 10 and a second base plate 20 disposed opposite to each other, a first transmission line 1 disposed on a side of the first base plate 10 proximal to the second base plate 20, a second transmission line 2 disposed on a side of the second base plate 20 proximal to the first base plate 10, a dielectric layer disposed between a layer where the first transmission line 1 is located and a layer where the second transmission line 2 is located, and a ground electrode 4. For example, the dielectric layer includes, but is not limited to, a liquid crystal layer 3, and the following embodiments will be described by taking an example in which the dielectric layer is the liquid crystal layer. Each of the first transmission line 1 and the second transmission line 2 includes, but is not limited to, a microstrip (which may also referred to as a microstrip line), and the ground electrode 4 may be disposed on a side of the first base plate 10 distal to the first transmission line 1. Each of the first transmission line 1 and the second transmission line 2 may be a comb-shaped electrode, and the ground electrode 4 may be a plate-shaped electrode, i.e., the first transmission line 1, the second transmission line 2 and the ground electrode 4 form a microstrip line transmission structure. Alternatively, the first transmission line 1, the second transmission line 2 and the ground electrode 4 may also form any one of a stripline transmission structure, a coplanar waveguide transmission structure, and a substrate-integrated waveguide transmission structure, which will not be exhaustively listed here.

In the related art, when a microwave signal is input to a phase shifter via a balun structure, the balun structure is generally connected to the phase shifter in a welding (direct) manner for feeding. For this manner, there are two mechanisms of applying a frame sealant on a thick copper wire (i.e., a transmission line): ① for a straight-through balun structure, it needs the frame sealant to be provided between a balun output terminal and a phase shifting section of the phase shifter to separate them from each other, and ② the welded transmission line needs to penetrate through the frame sealant so as to extend to an edge of a welding pad. During a manufacturing process of a liquid crystal phase shifter, the problems of sealant breakage, nonuniformity thickness of a cell, liquid leakage, and the like may occur due to applying the frame sealant on the thick copper wire. In view of the problems of the existing balun structure that feeds power in the welding (direct) manner, embodiments of the present disclosure provide technical solutions as follows. In a first aspect, an embodiment of the present disclosure provides a balun assembly, which includes: a first substrate 100, a first dielectric layer 300, a first transmission electrode 11, a second transmission electrode 21, a third transmission electrode 22, and a ground electrode 12. For example, the first substrate 100 has a first surface and a second surface opposite to each other. The first transmission electrode 11 is disposed on the first surface of the first substrate 100. The ground electrode 12 has an opening 121 therein, and is disposed on a side (i.e., the second surface) of the first substrate 100 distal to the first surface. The first dielectric layer 300 is disposed on a side of the ground electrode 12 distal to the first substrate 100. The second transmission electrode 21 and the third transmission electrode 22 are disposed on a side of the first dielectric layer 300 distal to the ground electrode 12. Each of an orthographic projection of the first transmission electrode 11 on the first substrate 100, an orthographic projection of the second transmission electrode 21 on the first substrate 100, and an orthographic projection of the third transmission electrode 22 on the first substrate 100 intersects with an orthographic projection of the opening 121 on the first substrate 100, and intersection points of the orthographic projection of the first transmission electrode 11 on the first substrate 100, the orthographic projection of the second transmission electrode 21 on the first substrate 100, and the orthographic projection of the third transmission electrode 22 on the first substrate 100 intersecting with the orthographic projection of the opening 121 on the first substrate are a first intersection point N1, a second intersection point N2, and a third intersection point N3, respectively. The first intersection point N1 is located between the second intersection point N2 and the third intersection point N3.

It should be noted that the "intersection point" in an embodiment of the present disclosure may refer to a region where two orthographic projections intersect each other, and the region may be a point or may have a certain area. For example, the first intersection point N1 of the orthographic projections of the opening 121 and the first transmission electrode 11 on the first substrate 100 is a rectangular region having a certain area.

In the present embodiment, the ground electrode 12 is disposed between the first substrate where the first transmission electrode 11 is located and the first dielectric layer 300 where the second transmission electrode 21 and the third transmission electrode 22 are located, the ground electrode 12 has the opening 121 therein, intersection points of the orthographic projections of the first transmission electrode 11, the second transmission electrode 21 and the third transmission electrode 22 on the first substrate 100 intersecting with the orthographic projection of the opening 121 on the first substrate are the first intersection point N1, the second intersection point N2, and the third intersection point N3, respectively, and the first intersection point N1 is located between the second intersection point N2 and the third intersection point N1 As such, a microwave signal transmitted on the first transmission electrode 11 is respectively coupled, by an electromagnetic coupling effect, to the second transmission electrode 21 and the third transmission electrode 22 through the opening 121 of the ground electrode 12, so as to be transmitted. That is, in the balun structure (i.e., the balun assembly) provided by the present embodiment, the first transmission electrode 11, the second transmission electrode 21, and the third transmission electrode 22 transmit the microwave signal in a coupling manner. Compared with the welding connection feeding scheme in the related art, the balun structure according to the present embodiment has a higher feeding efficiency and a reflection bandwidth up to about 15%, and can achieve a phase difference of 180°.

Figure 2:
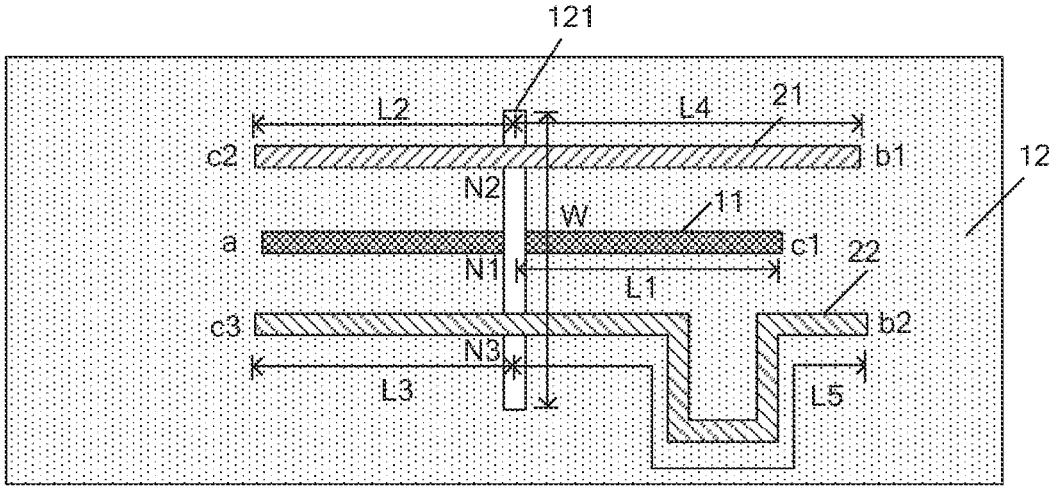
FIG. 2 is a schematic diagram of a forward coupling balun assembly according to an embodiment of the present disclosure.

In an example, FIG. 2 is a schematic diagram of a forward coupling balun assembly according to an embodiment of the present disclosure. As shown in FIG. 2, the orthographic projections of the first transmission electrode 11, the second transmission electrode 21, and the third transmission electrode 22 on the first substrate 100 do not overlap each other, and are respectively perpendicular to the orthographic projection of the opening 121 on the first substrate, resulting in the first intersection point N1, the second intersection point N2, and the third intersection point N3, respectively. An orthographic projection of a second open end c2 of the second transmission electrode 21 on the first substrate 100 and an orthographic projection of a third open end c3 of the third transmission electrode 22 on the first substrate 100 are located on a same side of the opening 121. For example, the first transmission electrode 11 has a first signal end a and a first open end c1 opposite to each other, the second transmission electrode 21 has a second signal end hi and the second open end c2 opposite to each other, and the third transmission electrode 22 has a third signal end b2 and the third open end c3 opposite to each other. A line length of the first transmission electrode 11 from the first open end c1 to the first intersection point N1 is L1, a line length of the second transmission electrode 21 from the second open end c2 to the second intersection point N2 is L2, a line length of the third transmission electrode 22 from the third open end c3 to the third intersection point N3 is L3, a line length of the second transmission electrode 21 between the second signal end b1 and the second intersection point N2 is L4, and a line length of the third transmission electrode 22 between the third signal end b2 and the third intersection point N3 is L5. An impedance of the first transmission electrode 11 is Z1, and a parallel impedance of the second transmission electrode 21 and the third transmission electrode 22 is Z2. In order to realize that two signals respectively output from the second transmission electrode 21 and the third transmission electrode 22 have equal amplitudes and opposite phases, a length W of a side, which is perpendicular to the second transmission electrode 21 and the third transmission electrode 22, of the opening 121 in the ground electrode 12 ranges from ¼ of a medium wavelength to ½ of the medium wavelength. Each of the line lengths L1, L2 and L3 is substantially equal to ¼ of the medium wavelength, and the line lengths L4 and L5 have a difference of ½ of the medium wavelength therebetween. For example, a distance between the intersection points N1 and N2 is equal to a distance between the intersection points N1 and N3. In the present embodiment, description is made by taking an example in which the line length L5 is longer than the line length L4 by ½ of the medium wavelength.

It should be noted that, the medium wavelength refers to a wavelength of an electromagnetic wave in a medium, and is related to a permittivity (which may be also referred to as a dielectric constant) of the medium. The expression that each of the line lengths L1, L2 and L3 is substantially equal to ¼ of the medium wavelength means that, each of the line lengths L1, L2 and L3 is equal to ¼ of the medium wavelength, or is equal to ¼ of the medium wavelength plus or minus an error value which may be defined according to an accuracy requirement of the balun assembly.

Referring to FIG. 2 again, in some embodiments, a portion of the third transmission electrode 22 between the third intersection point N3 and the third signal end b2 includes a serpentine line to reduce a size of the balun assembly, since the line length L5 is longer than the line length L4 by ½ of the medium wavelength, i.e., since the third transmission electrode 22 is longer than the second transmission electrode 21 by ½ of the medium wavelength. In some embodiments, the serpentine line may have any one of a shape of a Chinese character meaning a bow (e.g., a rectangular wave shape), a wave shape, and a zigzag shape. However, the serpentine line is not limited to these structures, and a structure of the serpentine line may b designed according to the impedance requirement of the balun assembly.

Figure 3:
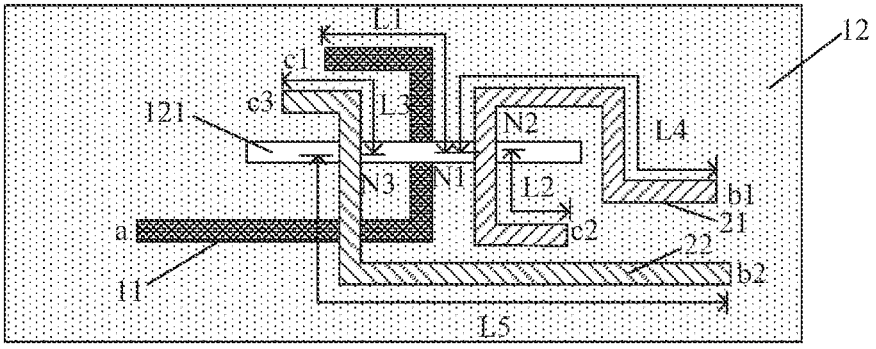
FIG. 3 is a schematic diagram of a reverse coupling balun structure according to an embodiment of the present disclosure.

In another example, FIG. 3 is a schematic diagram of a reverse coupling balun structure (e.g., a reverse coupling balun assembly or a backward coupling balun assembly) according to an embodiment of the present disclosure. As shown in FIG. 3, each of the first transmission electrode 11, the second transmission electrode 21, and the third transmission electrode 22 is a serpentine line, the orthographic projections of the second transmission electrode 21 and the third transmission electrode 22 on the first substrate 100 do not overlap each other, and the orthographic projections of the first transmission electrode 11, the second transmission electrode 21, and the third transmission electrode 22 on the first substrate 100 are perpendicular to an orthographic projection of the opening 121 on the first substrate in a length direction of the opening 121, resulting in the first intersection point N1, the second intersection point N2, and the third intersection point N3, respectively. The orthographic projections of the second open end c2 of the second transmission electrode 21 and the third open end c3 of the third transmission electrode 22 on the first substrate 100 are located on different sides of the opening 121. For example, the first transmission electrode 11 has the first signal end a and the first open end el opposite to each other. The second transmission electrode 21 has the second signal end hi and the second open end c2 opposite to each other. The third transmission electrode 22 has the third signal end b2 and the third open end c3 opposite to each other. The line length of the first transmission electrode 11 from the first open end a to the first intersection point N1 is L1, the line length of the second transmission electrode 21 from the second open end c2 to the second intersection point N2 is L2, the line length of the third transmission electrode 22 from the third open end c3 to the third intersection point N3 is L3, the line length of the second transmission electrode 21 between the second signal end b1 and the second intersection point N2 is L4, and the line length of the third transmission electrode 22 between the third signal end b2 and the third intersection point N3 is L5. The impedance of the first transmission electrode 11 is Z1, and the parallel impedance of the second transmission electrode 21 and the third transmission electrode 22 is Z2. In order to realize that two signals respectively output from the second transmission electrode 21 and the third transmission electrode 22 have equal amplitudes and opposite phases, the length W of the side, which is perpendicular to the second transmission electrode 21 and the third transmission electrode 22, of the opening 121 in the ground electrode 12 ranges from ¼ of the medium wavelength to ½ of the medium wavelength. Each of the line lengths L1, L2 and L3 is substantially equal to ¼ of the medium wavelength, and the line lengths L4 and L5 are equal to each other. For example, the distance between the intersection points N1 and N2 is equal to the distance between the intersection points N1 and N3.

It should be noted that, the expression that each of the line lengths L1, L2 and L3 is substantially equal to ¼ of the medium wavelength means that, each of the line lengths L1, L2 and L3 is equal to ¼ of the medium wavelength, or is equal to ¼ of the medium wavelength plus or minus an error value which may be defined according to an accuracy requirement of the balun assembly. Further, in a case where the distance between the intersection points N1 and N2 is equal to the distance between the intersection points N1 and N3, the impedance Z1 of the first transmission electrode 11 is slightly greater than the parallel impedance Z2 of the second transmission electrode 21 and the third transmission electrode 22, thereby achieving better power distribution. If a difference between the distance between the intersection points N1 and N2 and the distance between the intersection points N1 and N3 is smaller, it may be necessary that a difference between the impedance Z1 of the first transmission electrode 11 and the parallel impedance Z2 of the second transmission electrode 21 and the third transmission electrode 22 is larger to achieve distribution of equal powers.

Referring to FIG. 2 again, in some embodiments, each serpentine line may have any one of a shape of a Chinese character meaning a bow (e.g., a rectangular wave shape), a wave shape, and a zigzag shape. However, each serpentine line is not limited to these structures, and a structure of each serpentine line may be designed according to the impedance requirement of the balun assembly. Since in the reverse coupling balun assembly, according to the present embodiment, each of the first transmission electrode 11, the second transmission electrode 21, and the third transmission electrode 22 is the serpentine line, a size of the balun assembly can be reduced.

It should be noted that, although a structure of only one exemplary reverse (or backward) coupling balun assembly is described above, the present disclosure is not limited thereto. For example, the present disclosure may include the reverse balun assembly having any structure in which the orthographic projections of the second open end c2 of the second transmission electrode 21 and the third open end c3 of the third transmission electrode 22 on the first substrate 100 are located on different sides of the opening 121, respectively.

For example, in the forward coupling balun assembly or the reverse coupling balun assembly, the second transmission electrode 21 and the third transmission electrode 22 may be disposed in a same layer, or in different layers, respectively. Exemplary structures in which the second transmission electrode 21 and the third transmission electrode 22 are disposed in a same layer and are disposed in different layers, respectively, will be described below.

Figure 4:
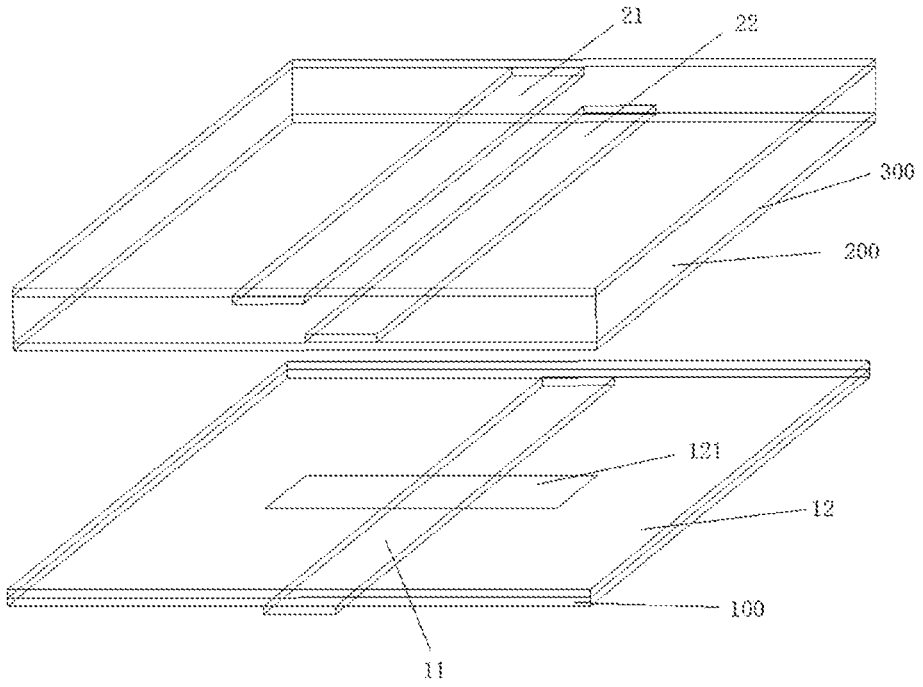
FIG. 4 is a schematic structural diagram of a balun assembly in an embodiment of the present disclosure.

FIG. 4 is a schematic diagram showing a structure of a balun assembly according to an embodiment of the present disclosure. As shown in FIG. 4, the balun assembly may include: an output signal line, the first substrate 100, the ground electrode 12, the first dielectric layer 300, the second transmission electrode 21, a second dielectric layer, the third transmission electrode 22, and a second substrate 200, which are arranged in sequence from bottom to top. That is, the second transmission electrode 21 and the third transmission electrode 22 are disposed in two layers, respectively, and the second dielectric layer is disposed between a layer of the second transmission electrode 21 and a layer of the third transmission electrode 22. For example, the second dielectric layer includes, but is not limited to, a liquid crystal layer (not shown).

It should be noted that in FIG. 4, for the purpose of clearly showing the structure of each layer, the first dielectric layer 300 is spaced apart from the ground electrode 12. However, the first dielectric layer 300 may be in contact with the ground electrode 12 in practice. In addition, the ground electrode 12 may be formed on a side of the first dielectric layer distal to the second substrate 200 when the balun assembly is manufactured.

When the balun assembly according to an embodiment of the present disclosure is applied to a phase shifter, the first base plate 10 of the phase shifting structure and the first dielectric layer 300 may be a one-piece structure, the second substrate 200 and the second base plate may be a one-piece structure, and a liquid crystal layer 3 of the balun assembly and the liquid crystal layer 3 of the phase shifting structure may be a one-piece structure. Further, the second transmission electrode 21 and the first transmission line 1 may be a one-piece structure, the third transmission electrode 22 and the second transmission line 2 may be a one-piece structure, and the ground electrode 12 and the ground electrode 4 may be a one-piece structure. As such, the manufacturing cost of the phase shifter may not be increased.

Figure 5:
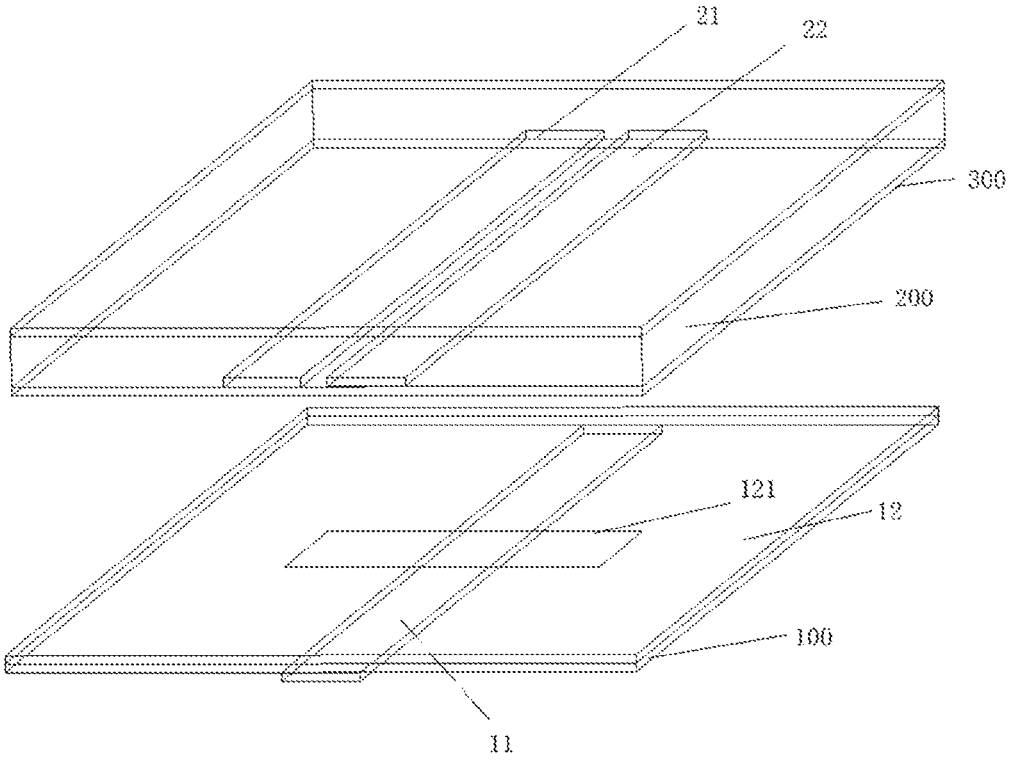
FIG. 5 is a schematic structural diagram of another balun assembly in the embodiment of the present disclosure.

FIG. 5 is a schematic diagram showing a structure of another balun assembly according to an embodiment of the present disclosure. As shown in FIG. 5, the difference between the balun assembly according to the present embodiment and the balun assembly shown in FIG. 4 lies only in that, both the second transmission electrode 21 and the third transmission electrode 22 are disposed on the first dielectric layer 300. The remaining structures of the balun assembly according to the present embodiment are the same as those structures of the balun assembly shown in FIG. 4, and thus the detailed description thereof is not repeated here. Alternatively, in some embodiments, the second transmission electrode 21 and the third transmission electrode 22 may be disposed on a side of the second substrate 200 distal to the first dielectric layer 300, It should be noted that in FIG. 5, for the purpose of clearly showing the structure of each layer, the first dielectric layer 300 is spaced apart from the ground electrode 12. However, the first dielectric layer 300 may be in contact with the ground electrode 12 in practice. In addition, the ground electrode 12 may be formed on a side of the first dielectric layer distal to the second substrate 200 when the balun assembly is manufactured.

In addition, it should be noted that the shapes of the second transmission electrode 21 and the third transmission electrode 22 in FIGS. 4 and 5 are merely illustrative, and do not mean the actual shapes of the second transmission electrode 21 and the third transmission electrode 22.

In some embodiments, each of the first transmission electrode 11, the second transmission electrode 21, and the third transmission electrode 22 includes a microstrip, and the ground electrode 12 includes the ground electrode 4. A material of each of the first transmission electrode 11, the second transmission electrode 21, the third transmission electrode 22, and the ground electrode 12 may include a metal such as copper, aluminum, silver, gold, chromium, molybdenum, nickel, iron, or the like.

In some embodiments, the opening 121 in the ground electrode 12 has a shape of a rectangle, but an embodiment of the present disclosure is not limited thereto. For example, the opening 121 in the ground electrode 12 may alternatively have any another shape.

In some embodiments, each of the first dielectric layer 300, the first substrate 100, and the second substrate 200 may be a glass substrate with a thickness of 100 microns to 1000 microns, or may be a sapphire substrate, or may be a polyethylene terephthalate substrate, a triallyl cyanurate substrate or a transparent flexible polyimide substrate, which has a thickness of 10 microns to 500 microns. Alternatively, each of the first dielectric layer 300, the first substrate 100, and the second substrate 200 may be made of high-purity quartz glass having extremely low dielectric loss. Compared with a general glass substrate, the first dielectric layer 300, the first substrate 100 and the second substrate 200 made of the quartz glass can effectively reduce a loss of a microwave, such that the phase shifter have low power consumption and a high signal-to-noise ratio.

For example, liquid crystal molecules of the liquid crystal layer 3 may be positive liquid crystal molecules or negative liquid crystal molecules. It should be noted that, in a case where the liquid crystal molecules are the positive liquid crystal molecules, an angle between a long axis direction of each liquid crystal molecule and the second transmission electrode according to an embodiment of the present disclosure is greater than zero and less than or equal to 45°. In a case where the liquid crystal molecules are the negative liquid crystal molecules, the angle between the long axis direction of each liquid crystal molecule and the second transmission electrode is greater than 45° and less than 90°. As such, it is ensured that the permittivity (i.e., the dielectric constant) of the liquid crystal layer 3 is changed after the liquid crystal molecules are caused to rotate, thereby achieving the purpose of phase shifting.

In a second aspect, the embodiments of the present disclosure further provide a microwave radio frequency device including the balun assembly according to any one of the foregoing embodiments, and the microwave radio frequency device may include, but is not limited to, a filter or a phase shifter.

In a third aspect, the embodiments of the present disclosure further provide a liquid crystal antenna, which includes the phase shifter according to any one of the foregoing embodiments. For example, at least two patch units are further disposed on a side of the second base plate 20 distal to the liquid crystal layer 3, and a gap between any adjacent two of the patch units is provided corresponding to a gap between electrode strips. In this way, a microwave signal phase-adjusted by the phase shifter according to any one of the foregoing embodiments can be radiated from the gap between any adjacent two of the patch elements.

It should be understood that the foregoing embodiments are merely exemplary embodiments adopted to explain the principles of the present disclosure, and the present disclosure is not limited thereto. It will be apparent to one of ordinary skill in the art that various modifications and improvements can be made without departing from the spirit and scope of the present disclosure, and such modifications and improvements also fall within the scope of the present disclosure.

What is claimed is:

1. A balun assembly, comprising:

a first substrate having a first surface and a second surface opposite to each other;

a first transmission electrode on the first surface of the first substrate;

a ground electrode having an opening therein, the ground electrode being on the second surface of the first substrate distal to the first transmission electrode;

a first dielectric layer on a side of the ground electrode distal to the first substrate; and a second transmission electrode and a third transmission electrode both on a side of the first dielectric layer distal to the ground electrode, the second transmission electrode and the third transmission electrode being spaced apart from each other, wherein each of an orthographic projection of the first transmission electrode on the first substrate, an orthographic projection of the second transmission electrode on the first substrate, and an orthographic projection of the third transmission electrode on the first substrate overlaps an orthographic projection of the opening on the first substrate, the orthographic projections of the first transmission electrode, the second transmission electrode and the third transmission electrode on the first substrate intersect with the orthographic projection of the opening on the first substrate at a first intersection point, a second intersection point, and a third intersection point, respectively, and the first intersection point is between the second intersection point and the third intersection point.

2. The balun assembly according to claim 1, wherein the first transmission electrode has a first signal end and a first open end opposite to each other, the second transmission electrode has a second signal end and a second open end opposite to each other, and the third transmission electrode has a third signal end and a third open end opposite to each other; and a line length of the first transmission electrode from the first open end to the first intersection point is L1, a line length of the second transmission electrode from the second open end to the second intersection point is L2, a line length of the third transmission electrode from the third open end to the third intersection point is L3, and each of the line lengths L1, L2 and L3 is substantially equal to ¼ of a medium wavelength.

3. The balun assembly according to claim 1, wherein an orthographic projection of the second open end on the first substrate and an orthographic projection of the third open end on the first substrate are on a same side of the opening, a line length of the second transmission electrode from the second intersection point to the second signal end is L4, a line length of the third transmission electrode from the third intersection point to the third signal end is L5, and the line lengths L5 and L4 have a difference of ½ of a medium wavelength therebetween.

4. The balun assembly according to claim 3, wherein a portion of the third transmission electrode from the third intersection point to the third signal end comprises a serpentine line.

5. The balun assembly according to claim 1, wherein an orthographic projection of the second open end on the first substrate and an orthographic projection of the third open end on the first substrate are on both sides of the opening, respectively, a line length of the second transmission electrode from the second intersection point to the second signal end is L4, a line length of the third transmission electrode from the third intersection point to the third signal end is L5, and the line lengths L4 and L5 are substantially equal to each other.

6. The balun assembly according to claim 5, wherein each of the first transmission electrode, the second transmission electrode, and the third transmission electrode comprises a serpentine line.

7. The balun assembly according to claim 1, wherein the balun assembly further comprises a second substrate opposite to the first dielectric layer and at a side of the first dielectric layer distal to the ground electrode, both the second transmission electrode and the third transmission electrode are on the first dielectric layer, and a second dielectric layer is between a layer where the second transmission electrode and the third transmission electrode are located and the second substrate.

8. The balun assembly according to claim 1, wherein the balun assembly further comprises a second substrate opposite to the first dielectric layer and at a side of the first dielectric layer distal to the ground electrode;

one of the second transmission electrode and the third transmission electrode is on the first dielectric layer, and the other of the second transmission electrode and the third transmission electrode is on a side of the second substrate proximal to the first dielectric layer; or both the second transmission electrode and the third transmission electrode are on a side of the second substrate proximal to the first dielectric layer; and a second dielectric layer is between a layer where the second transmission electrode is located and a layer where the third transmission electrode is located.

9. The balun assembly according to claim 7, wherein the second dielectric layer comprises a liquid crystal layer.

10. The balun assembly according to claim 1, wherein a width of the opening in an extension direction of the opening ranges from ¼ of a medium wavelength to ½ of the medium wavelength.

11. A microwave radio frequency device, comprising the balun assembly according to claim 1.

12. The microwave radio frequency device according to claim 11, wherein the microwave radio frequency device comprises a phase shifter or a filter.

13. An antenna, comprising the microwave radio frequency device according to claim 11.

14. The balun assembly according to claim 2, wherein an orthographic projection of the second open end on the first substrate and an orthographic projection of the third open end on the first substrate are on a same side of the opening, a line length of the second transmission electrode from the second intersection point to the second signal end is L4, a line length of the third transmission electrode from the third intersection point to the third signal end is L5, and the line lengths L5 and L4 have a difference of ½ of a medium wavelength therebetween.

15. The balun assembly according to claim 14, wherein a portion of the third transmission electrode from the third intersection point to the third signal end comprises a serpentine line.

16. The balun assembly according to claim 2, wherein an orthographic projection of the second open end on the first substrate and an orthographic projection of the third open end on the first substrate are on both sides of the opening, respectively, a line length of the second transmission electrode from the second intersection point to the second signal end is L4, a line length of the third transmission electrode from the third intersection point to the third signal end is L5, and the line lengths L4 and L5 are substantially equal to each other.

17. The balun assembly according to claim 16, wherein each of the first transmission electrode, the second transmission electrode, and the third transmission electrode comprises a serpentine line.

18. The balun assembly according to claim 2, wherein a width of the opening in an extension direction of the opening ranges from ¼ of a medium wavelength to ½ of the medium wavelength.

19. The balun assembly according to claim 3, wherein a width of the opening in an extension direction of the opening ranges from ¼ of a medium wavelength to ½ of the medium wavelength.

20. The balun assembly according to claim 5, wherein a width of the opening in an extension direction of the opening ranges from ¼ of a medium wavelength to ½ of the medium wavelength.

* * * * *